United States Patent [19]

Anderson et al.

[11] Patent Number: 4,887,718

[45] Date of Patent: Dec. 19, 1989

[54] CARTON END CLOSURE

[75] Inventors: David S. Anderson, Brooklyn Park; Michael E. Geddis, Plymouth, both of Minn.

[73] Assignee: General Mills, Inc., Minneapolis, Minn.

[21] Appl. No.: 290,055

[22] Filed: Dec. 27, 1988

[51] Int. Cl.[4] ..... B65D 5/70

[52] U.S. Cl. ..... 206/611; 206/621.3; 206/621.5; 206/626; 229/155; 229/160.2

[58] Field of Search ..... 206/626, 611, 621.3, 206/621.5, 631, 631.1; 229/155, 160.2

[56] References Cited

U.S. PATENT DOCUMENTS

| | | | |
|---|---|---|---|
| 2,362,942 | 11/1944 | Spalding | 206/621.5 |
| 2,417,498 | 3/1947 | Hultin | 206/621.5 |
| 2,907,511 | 10/1959 | Saidel | 206/626 |
| 2,928,579 | 3/1960 | Graybill | 206/621.3 |
| 2,933,230 | 4/1960 | Yezek | 206/621.5 |
| 3,185,374 | 5/1965 | Feeney | 206/621.3 |
| 3,263,899 | 8/1966 | Collura et al. | 206/611 |
| 3,316,471 | 6/1964 | Brastad | 229/160.2 |
| 3,477,632 | 11/1969 | Donahue | 229/155 |
| 3,498,522 | 3/1970 | Peet | 206/626 |
| 4,718,557 | 1/1988 | Friedman | 206/621.3 |

FOREIGN PATENT DOCUMENTS

| | | | |
|---|---|---|---|
| 7514013 | 6/1977 | Netherlands | 229/160.2 |

OTHER PUBLICATIONS

9 Lives® Crunchy Meals Cat Food Carton, manufactured by Star—Kist Foots, Inc.

Chef's Blend Cat Food Carton, manufactured by Carniation Company.

*Primary Examiner*—Stephen P. Garbe

*Assistant Examiner*—Kathryn M. Stemann

*Attorney, Agent, or Firm*—John A. O'Toole

[57] ABSTRACT

Disclosed are cartons having a carton end closure having an easy open pull tab feature, a pour spout feature and reclosure feature. The cartons have siftproof corners notwithstanding eliminating an inner liner. The closure is fabricated from two defined major end flaps and a minor or side end flap. The major end flaps are defined by cuts, score lines and both transverse and longitudinal adhesive lines which upon initial opening form the reclosure elements. One piece carton blanks for such cartons are also disclosed.

7 Claims, 4 Drawing Sheets

CARTON END CLOSURE

TECHNICAL FIELD

The present invention relates to improvements in carton closures. More particularly, the present invention pertains to an improved closure formed of major and minor end flaps having an arrangement of adhesive or adhered spots, cuts, perforations and scores and other features which permit easy opening, a pour spout feature upon opening, and a reclosure feature.

BACKGROUND OF THE INVENTION

Cartons formed of paperboard such as bleached kraft, white coated paper newsboard and similar materials are well known in the art and are widely used. While commonplace, such articles appear simple but such appearances are deceptive. Cartons are carefully designed and constructed to accomplish multiple tasks.

The primary function of the carton, of course, is to contain its contents. Frequently, cartons are fabricated so as to contain an inner pouch or liner typically to provide additional moisture protection, e.g., for R-T-E cereals or to provide siftproof sealing for fine or granular material, e.g., flour or cake mixes. While enabling a simplified design, the addition of a liner adds costs to the container and adds complexity to filling and fabrication steps of their manufacture.

The present invention is, however, directed towards linerless cartons but which nonetheless are useful for the siftproof packaging of granular materials especially such as Potato Buds® brand granulated dehydrated mashed potatoes Other granulated materials such as laundry detergent can also be suitably packaged by the present cartons. Thus, an important performance characteristic is to prevent leakage of the fine granules or dust from the container both when initially sealed and also upon reclosure. Typically, leakage problems are most severe at carton corners and especially the upper corners.

Another function very desirable in a carton is to be easily openable. However, the employment of features and materials to make the carton siftproof such as improved strengths of heat seal bonds often interfere with the ease of opening such packages by the consumer.

Still another function which is desirable in a carton for granular materials is to have a spout feature. A spout feature assists in the controlled dispensing of the contents. The two important aspects of a spout feature are first to have a controlled opening of the open face of the container and second to have guides to control the outward flow of the contents during dispensing.

It is further desirable to have a reclosure feature for the carton where it is desirable to reclose the carton after dispensing less than all its contents. Such a feature becomes more important with larger sized cartons.

Still another advantage of an improved carton is to be able to be fabricated from a single carton blank without the need for additional structures such as discrete dispensing spouts or reclosure/spout elements. Such simplicity of design offers improvements in cost savings.

As can be readily appreciated, improvements in one aspect or function of a carton can undesirably adversely affect other functions. Carton design often involves numerous trade-offs in benefits. Accordingly, there is a continuing need for new, improved and innovative carton designs providing multiple desirable features at reduced cost. Surprisingly, the present invention provides such improved cartons containing such features by a combination of selected cut lines, score lines, perforation lines and adhesive lines. It is surprising that such dramatic combinations of features and cost benefits can be provided by such simple manufacturing techniques.

DESCRIPTION OF THE PREFERRED EMBODIMENTS

Figure 3:
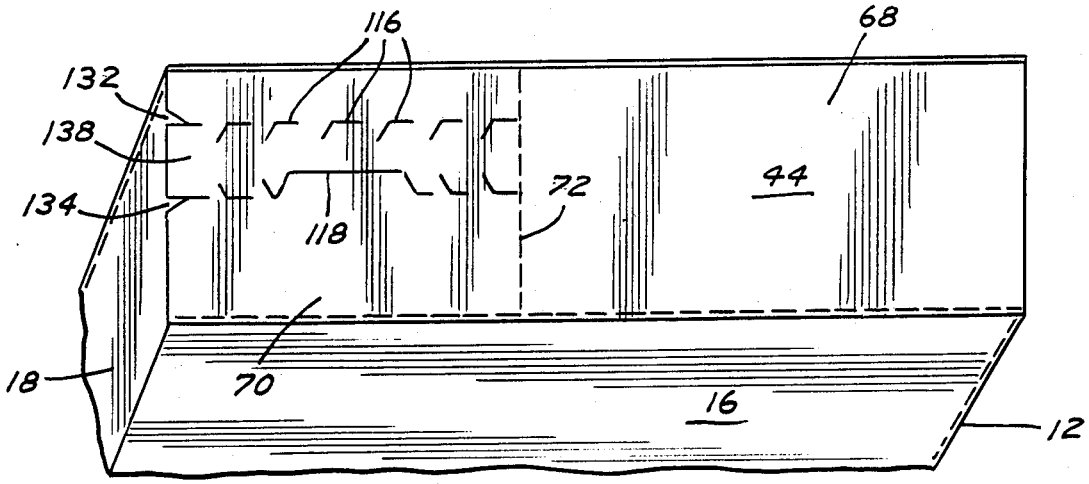
FIG. 3 is a perspective view similar to FIG. 2 with the other major closure flaps being folded to complete closure of the carton end and showing a compound tear strip.
Figure 4:
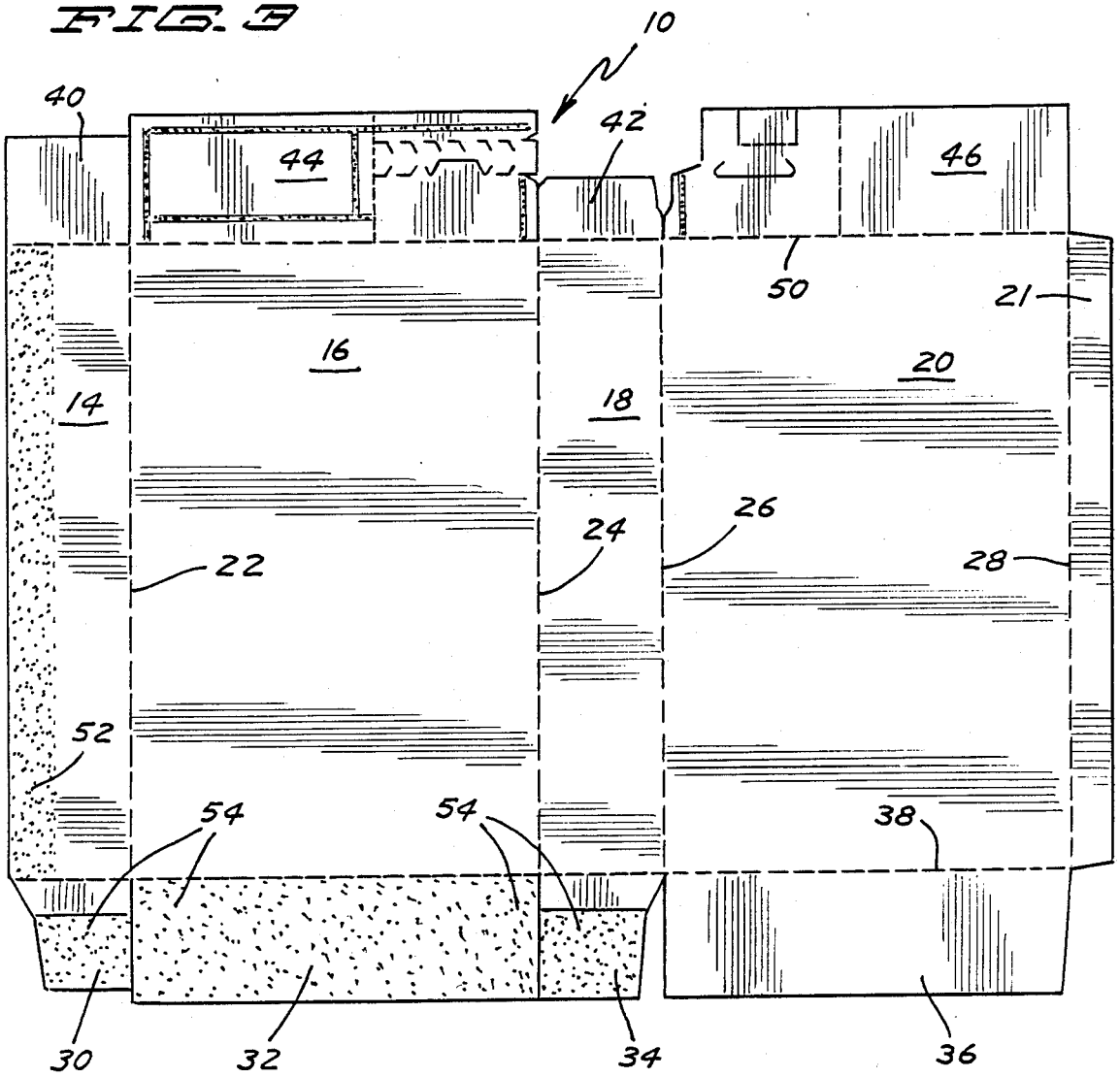
FIG. 4 is a plan view of the inner surfaces of a carton blank for forming one embodiment of the present invention.

Referring now to the drawings and in particular briefly initially to FIG. 4, there is shown a carton blank 10 for forming a carton 12 (illustrated in FIG. 3). The blank 10 can be fabricated out of conventional material such as bleached kraft, white coated newsboard, chipboard or other materials well known in the carton art.

The blank 10 is shown with the surface which later becomes the inside of the carton 12 being uppermost. Commonly, the outer surface (not shown) is white coated or clay coated and displays the carton's exterior graphics. The blank 10 includes contiguously a first side panel 14, a front panel 16, a second side panel 18, a rear panel 20, and a glue flap 21. These panels are hingedly connected along the vertical fold lines 22, 24, 26 and 28 as shown in FIG. 4. Hingedly attached to the lower portions of the panels 14, 16, 18 and 20 are bottom end flaps 30, 32, 34 and 36, respectively, along the lower horizontal fold line 38. Hingedly attached to the upper portions of panels 14, 16, 18, and 20 are top side or minor closure flaps 40 and 42 and top major closure flaps 44 and 46. The flaps 40, 42, 44, and 46 are hingedly connected or articulated along the upper horizontal fold line 50.

Figure 1:
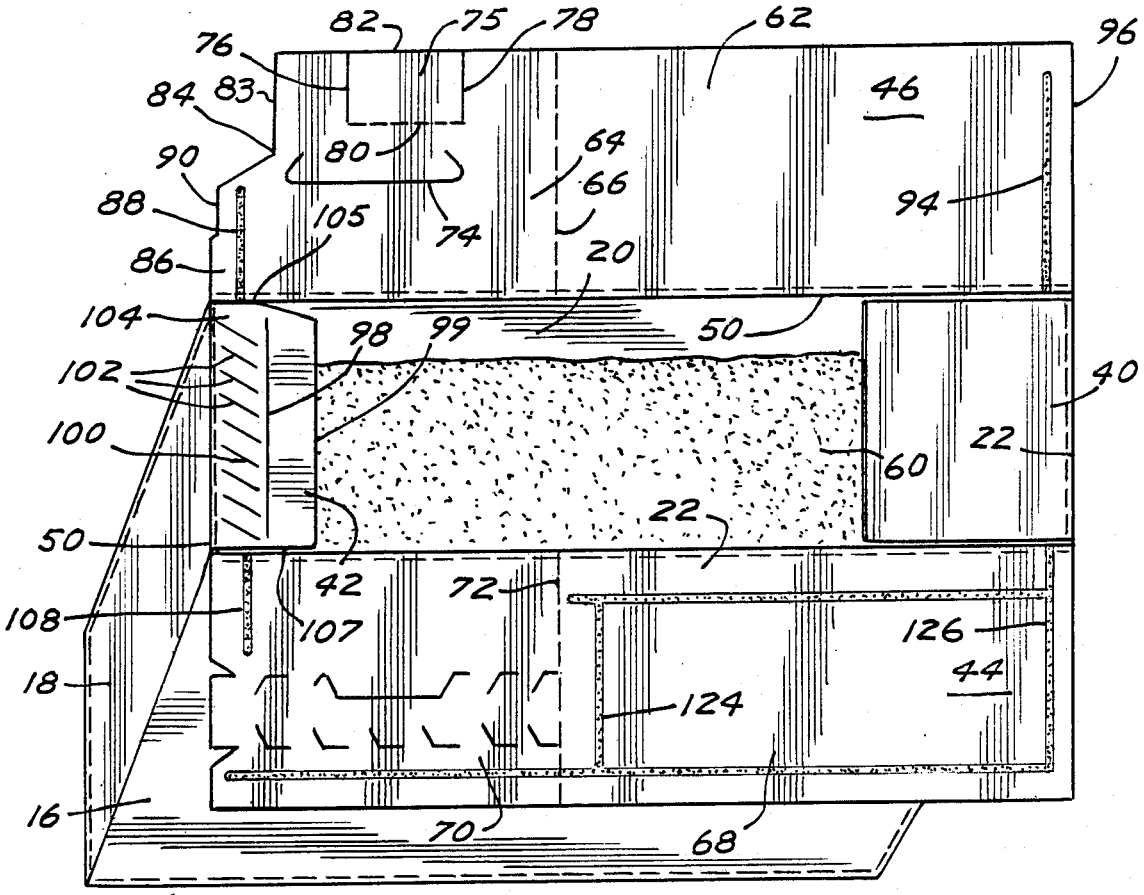
FIG. 1 is a perspective view of a carton partially cut away and depicting the carton end closure with the major end flaps disengaged, and with the minor closure flaps being folded inwardly to close partially the carton end.

In FIG. 4, it can be seen that panel 14 is provided with glue or adhesive 52 to form an adhesive portion or area. Further, flaps 30, 32, and 34 are each also provided with a glue or adhesive 54. To secure the carton 12 in its tubular shape as illustrated in FIG. 1, the glue panel 21 is adhesively bonded to adhesive portion 52. To close the carton bottom end, the bottom end flap 36 is folded along fold line 38. Thereafter, bottom end flaps 30 and 34 are each folded inwardly along fold line 38. The adhesive causes flaps 30 and 34 to adhere to end flap 36. Finally panel 32 whereby the adhesive 54 causes panel 32 to adhere to panels 30, 34 and 36 to form the carton's sealed bottom closure.

Reference is now made to FIG. 1. In FIG. 1 it can be seen that flaps 42 and 40 have been folded inwardly. FIG. 1 also shows a granular or powdery filling 60. FIG. 1 further shows that panel 46 comprises an inner end flap portion or piece 62 and a spout portion or piece 64 detachably joined along a transverse perforation line 66. Similarly, major outer closure flap 44 comprises an outer closed flap portion or piece 68 and an outer spout portion or piece 70 detachably joined along a transverse perforation line 72. It is further depicted that the inner spout piece 64 further comprises an inverted "C" style slit 74. Piece 64 further includes a thumb or finger hole feature 75 (best shown in FIG. 7) defined by an opposed pair of spaced apart, parallel transverse cut lines 76 and 78 and a longitudinally extending exterior score line 80. (By "score" line herein is meant a partial "cut," i.e., which only partially penetrates the carton material. By "exterior" is meant a score made from the outside surface.) Importantly, the cut lines 76 and 78 and exterior score line 80 are placed so as to situate the thumb hole feature 75 approximately half way along that portion of a longitudinally extending free edge 82 intermediate perforation line 66 and transversely extending free edge 83. Such placement of the thumb notch feature is essential to the combination of benefits herein; namely, ease of opening without tearing of flaps which form the spout and reclosure features of the present closure.

Still referring to FIG. 1, spout piece 64 is further shown to include a notch 84 there defining a tab portion 86 which tab portion includes a transverse bead of hot melt adhesive or glue 88 proximate to free edge 90. Hot melt glue is preferred to cold solutions of adhesives for the reason that such solutions do not form beads that can "caulk" the gaps between the closure flap elements. Portion 62 further includes a peripheral transverse bead 94 of hot melt glue proximate to free edge 96 which adheres to flap 40 forming a siftproof closure. The bead 94 is long enough so when the flap 62 is folded over, the bead 94 caulks the corners of the carton along free edge 22.

FIG. 1 further depicts that flap 42 is initially inwardly folded and is provided with a topical transverse median score line 98 intermediate fold line 50 and a free edge 99. Also, flap 42 includes at least angled score line 100, and in preferred embodiments a plurality of similar score lines 102 intermediate the score line 98 and that portion 104 of fold line 50 hingedly connecting flap 42 with panel 18. In preferred embodiments, there is about an 0.125 inch gap intermediate fold line portion 104 and score line(s) 100 and 102. Flap 42 can be fabricated from packaging stock having a topical exterior coating capable of delamination. The score lines 100 and optionally 102 as well as transverse score line 98 through the exterior coating assist in the controlled delamination of the exterior tropical coating of flap 42 upon initial opening. It can be seen that flap 42 is shorter in length (i.e., the length from fold 50 to free edge 99) relative to the opposed other minor end flap 40. Shortening the length of flap 42 avoids interference by flap 42 during opening when a finger is placed in the finger hole 75 as described below. Furthermore, flap 42 is square, i.e., not tapered, along at least a portion of upper free edge 105 so as to prevent dripping of glue bead 88 upon application into the container and thus possibly onto product 60. Similarly, flap 42 is square along lower free edge 107.

Figure 2:
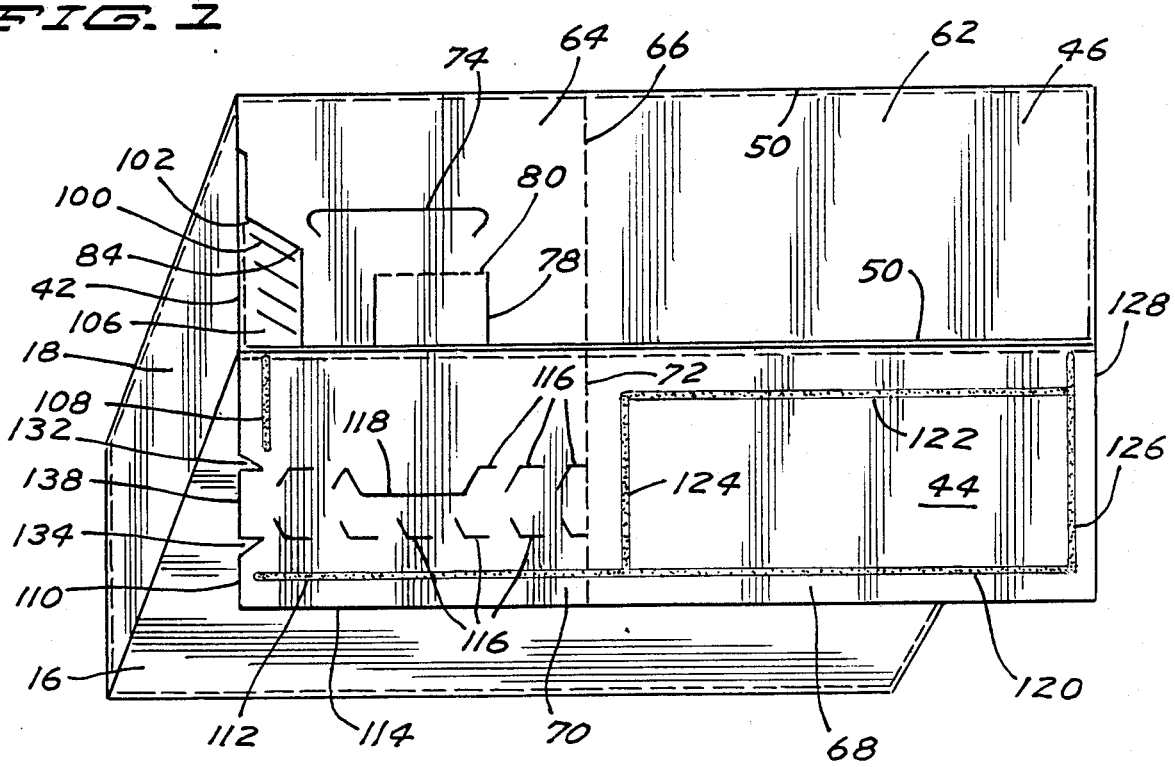
FIG. 2 is a perspective view similar to FIG. 1 with one major closure flap being folded inwardly to further partially close the carton end.

Referring now to FIG. 2 and as further described below, glue bead 88 will adhere to the covered portion of flap 42 and as flap 64 is pulled away glue bead 88 will tend to pull off the top surface or layer of flap 42, i.e., to delaminate. It is important that flap 42 remain intact both to assist in controlled pouring or dispensing of the contents 60 as well as to forming a good closure upon reclosure.

Still referring to FIG. 2, when flap 64 is folded inwardly, it can be seen that the notch 84 leaves a portion 106 of flap 42 exposed. Flap 70 is shown to include a short transverse bead 108 of hot melt glue parallel and proximate to free edge 110 and of a length adapted to adheringly engage portion 106 of flap 42 when flap 44 is folded inwardly (as shown in FIG. 2 along horizontal fold line 50). Importantly, beads 108 and 88 "caulk" the corners of carton along flap 42 to obtain siftproof corners.

Still referring to FIG. 2, it is seen that flap 70 additionally includes a longitudinally extending bead 112 of hot melt glue proximate and parallel to its outer free edge 114. Flap 70 further includes a plurality of pull tab cuts 116 and notches 132 and 134 which collectively form a pull tab 138 as well as a tuck tab cut 118 for additionally simultaneously forming a tuck tab.

FIG. 2 also shows that flap 44 further includes a longitudinal bead 120 of hot melt glue proximate and parallel to free edge 114. Typically, bead 120 is a continuation of bead 112 upon manufacture (or vice versa). Flap 44 includes a second longitudinal bead 122 of hot melt glue parallel to and spaced apart from bead 120 and proximate to that portion of fold line 50 hingedly connecting flap 44 to panel 16. Flap 44 further includes a transverse bead 124 of glue parallel and proximate to perforation line 72 and a transverse bead 126 of glue proximate to free edge 128. Glue bead 124 not only assists providing good seal properties to the present closure but also importantly assists in opening the closure along both perforation lines 72 and 66. Beads 120, 122, 124 and 126 each adhesively secures flap 62 when flap 44 is folded inwardly as shown in FIG. 3.

A brief reference is now made to FIG. 3 which depicts the top closure feature of the present invention when the carton 12 is fully assembled. Flap 70 further includes a pair of spaced notches 132 and 134 which in addition to pull tab cuts 116 and tuck tab cut 118 define a pull tab 138.

It is to be appreciated from the foregoing description that an important feature of the present carton closure that, importantly, all four corners of the closure are sealed topically with both transverse and longitudinal adhesive beads to provide the present desirable, siftproof sealing feature of the present invention. Also, it is to be appreciated that another distinctive feature of the present invention is the use of transverse glue beads in combination with longitudinal glue beads.

Generally, in the method of fabricating the present filled container, the carton blank 10 is first formed into a tube by flap 21 to be attached to flap 14 by glue 52 by means of a conventional carton machine. Next, the carton tube so formed is fed to the next fabrication station, namely wherein the bottom closure is formed by folding inwardly flap 36, then minor flaps 30 and 34, then flap 32. Thereafter, the carton is advanced to a fill station wherein the contents 60 are added. Then, the filled carton is advanced to a flap folder which folds inwardly minor flaps 40 and 42 and folds outwardly flaps 62 and 68 such that the container is presented with the flaps in the positions depicted in FIG. 1. Reference is now made again briefly to FIG. 1 for the purpose of describing a technique for fabricating the present container. The packaging machine can be equipped with a three nozzle glue gun for applying the transverse glue beads. The glue gun nozzles are electronically timed to deposit the transverse hot melt glue beads 88, 108, 94, 124 and 126 depicted in FIG. 1. Thereafter, the filled carton is advanced to the next station. As the carton is advanced, a pair of spaced glue nozzles apply to flap 68 the longitudinal glue beads 112, 120 and 122. At the next station flap 46 is next inwardly folded and immediately thereafter flap 68 is inwardly folded. The carton is next advanced to a compression chamber which holds the flaps in place while the glue cools and sets up to form the present container with the present improved closure. Thereafter, the packed carton item is advanced to a conventional case packer where units of the present cartons are combined into cases for sale and distribution.

OPERATION OF THE INVENTION

Figure 5:
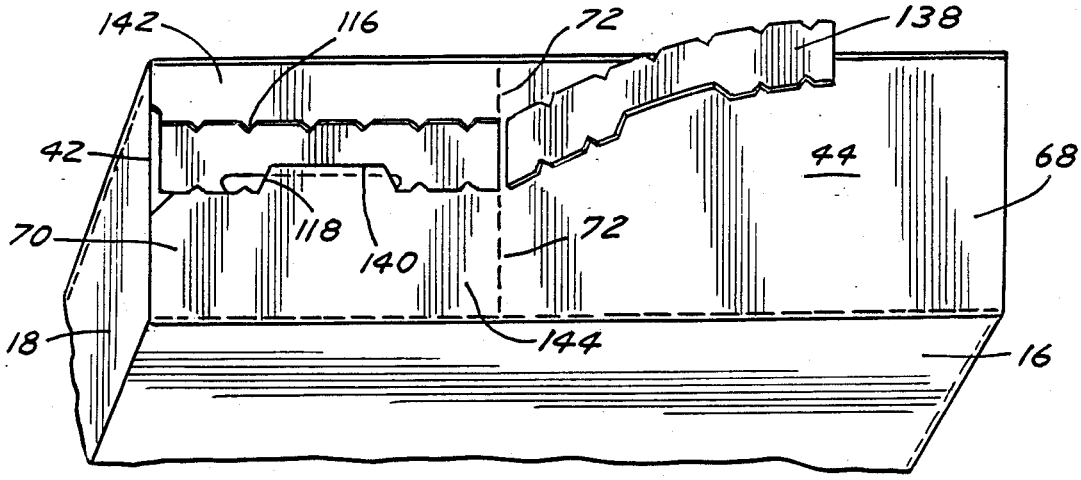
FIG. 5 is a perspective view similar to FIG. 3 but with the pull tab removed thereby defining a tuck tab.

Reference is now made to FIG. 5 which shows the opening sequence for the present closure. Initially, pull tab 138 is pulled longitudinally inwardly causing tearing along pull tab perforations 116 and tuck tab cut 118 whereby a tuck tab 140 is generated. The pull tab 138 tears freely away from and along perforation line 72 thereby forming a flap piece 142 as well as a tuck tab 140. Flap piece 142 is still removably connected to flap 68 only along score line 72 and also by glue bead 112 adhering to flap 64. Also a flap piece 144 is formed as well also removably connected along score line 72 to flap 68 but also (although not shown in FIG. 5) by glue bead 108 adhering to spout flap 42.

Figure 6:
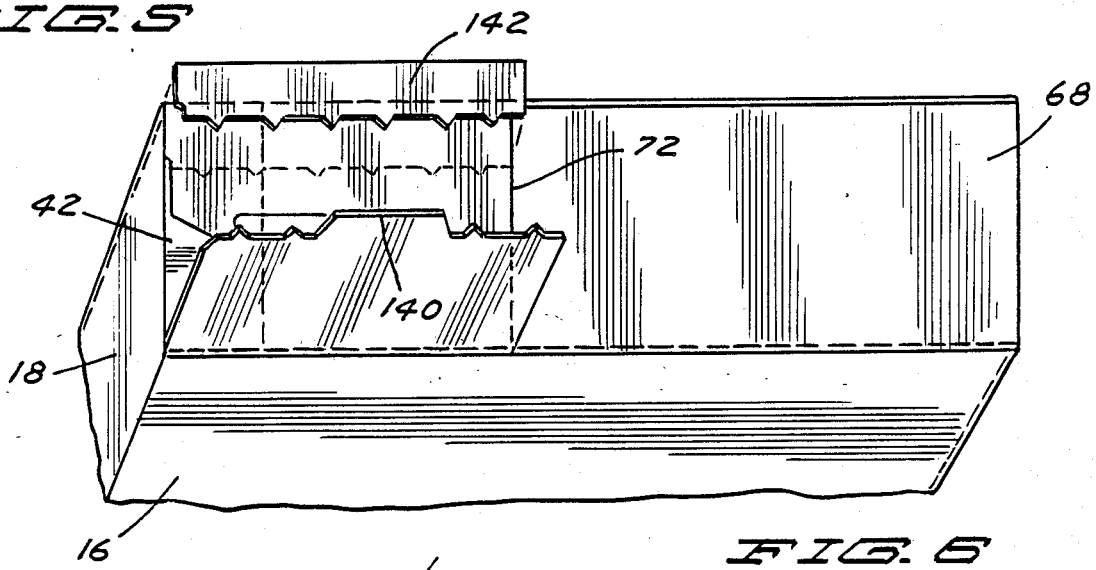
FIG. 6 is a perspective view similar to FIG. 5 showing the closure feature further partially opened.

Referring now to FIG. 6, flap piece 142 can be removed entirely by tearing along perforation line 72 and discarded. Tuck tab 140 is pulled outwardly causing tearing along perforation line 72 as well as disengagement of glue bead 108 (not shown). As indicated above, the disengagement of glue bead 108 upon opening is facilitated by the topical delamination of spout flap 42 assisted by score lines 102 as discussed above (better seen in FIG. 7).

Figure 7:
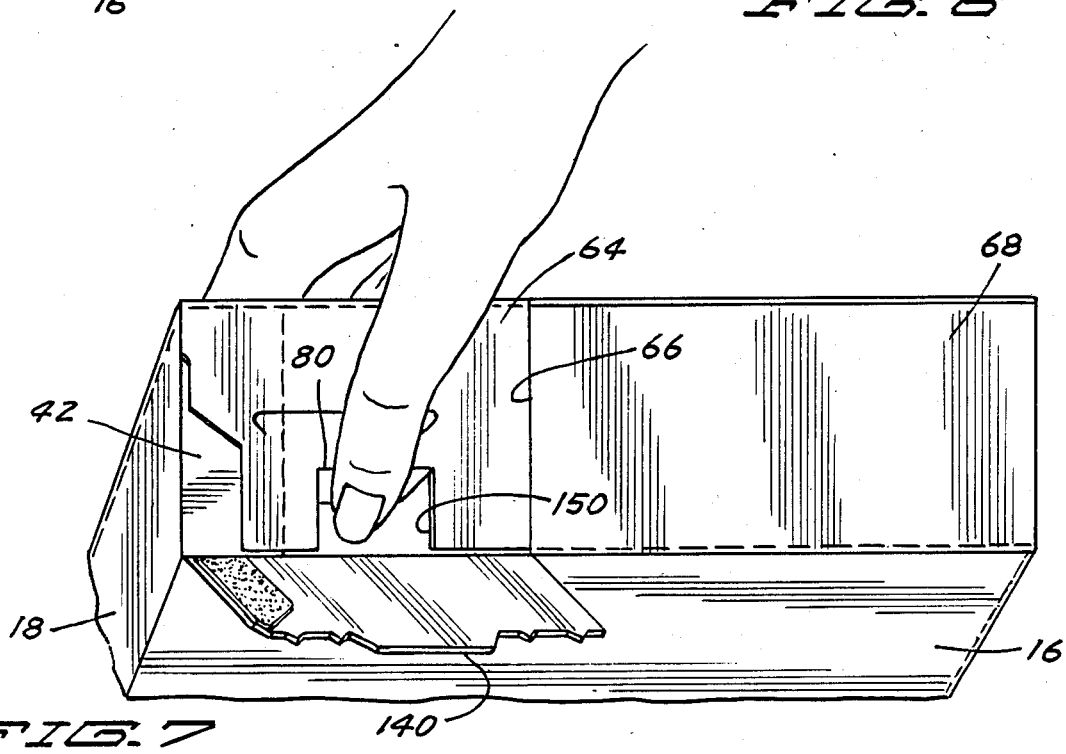
FIG. 7 is a perspective view similar to FIG. 6 showing the tuck tab flap folded away and disclosing a finger hole to facilitate opening of the spout by pulling the flap with the aid of the finger hole.

Now referring to FIG. 7, a digit, preferably and conveniently a thumb for right handed consumers, is inserted to create a finger hole 150 by folding along score line 80 to facilitate opening of flap 64. As the flap 64 is pulled outwardly, flap 64 tears along perforation line 66 as well as rupturing of now underlying glue bead 88 (not shown).

Figure 8:
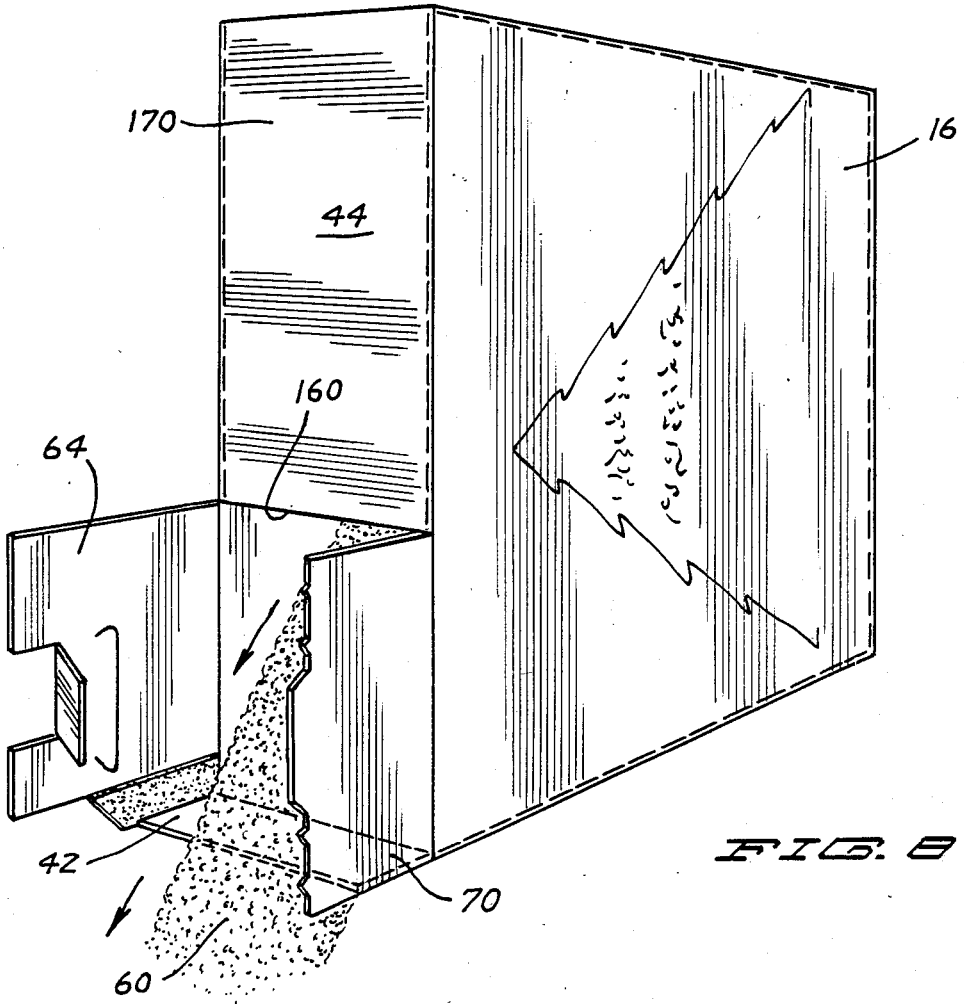
FIG. 8 is a perspective view similar to FIG. 7 with the finger hole flap torn open and folded outwardly exposing the minor spout flap.

Reference now is briefly made to FIG. 8 which shows the closure in an open position wherein flaps 64, 42 and tuck tab flap 70 are outwardly folded thereby forming the spout feature of the present invention for controlled dispensing of contents 60. The controlled dispensing is further facilitated by control of the size of an orifice 160 so formed by the manufacturer's control of the size of the fixed closure 170 which remains in place.

Figure 9:
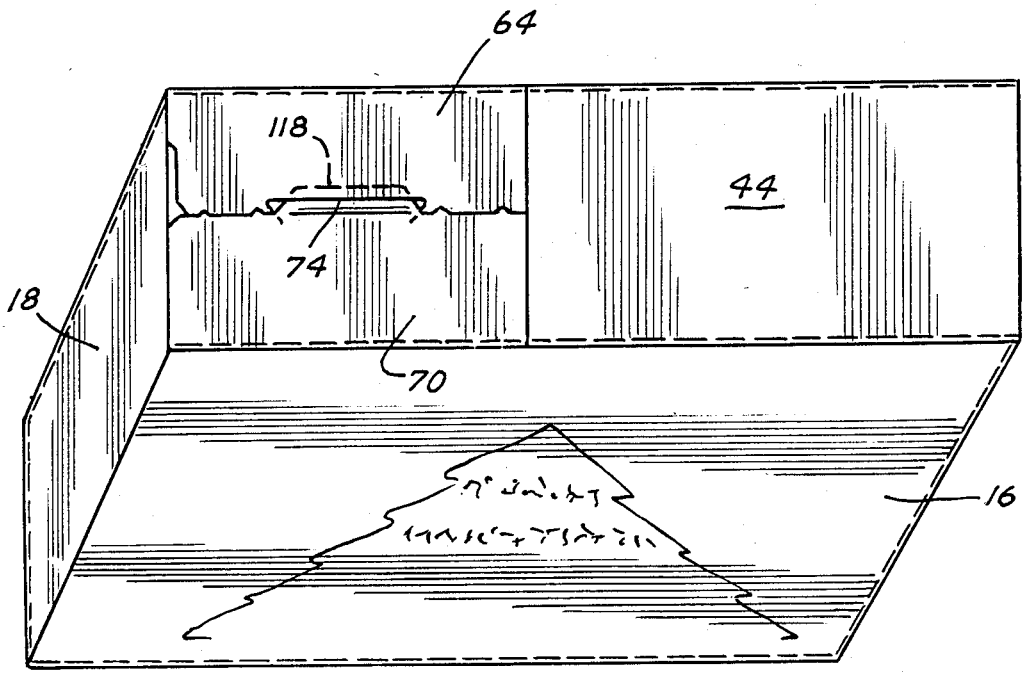
FIG. 9 is a perspective view similar to FIG. 8 showing engagement of the reclosure feature wherein the tuck tab is engaged with the tuck tab slit.

Reference is now made briefly to FIG. 9 which shows the reclosure feature of the present invention in an engaged position. As can be seen, the tuck tab 140 is engaged with the tuck tab slit 74 to form the reclosure feature without the use of an adhesive bond while the spout flap 42 is tucked under.

Without further elaboration it is believed that one skilled in the art can, using the preceding description, utilize the present invention to its fullest extent. It will be appreciated that other modifications of the present invention within the skill of those in the carton fabrication arts, can be undertaken without departing from the spirit and scope of this invention.

What is claimed is:

1. In a carton end closure for a rectangular carton body comprising a first major panel 20, a second panel 16, a first side panel 14, a second side panel 18 and a closed bottom and fabricated from a carton blank 10 for containing a powdered or granular material 60, wherein an improvement provides sift proof sealing without an inner liner and comprises:

A. a first major side flap 40 hingedly connected to the first side panel 14 inwardly folded;

B. a second rectangular minor side flap 42 hingedly connected at a first end to the second side panel 18 inwardly folded, said second minor flap 42 having, an opposed major free edge 99 at its second end,
- an opposed pair of minor free edges 105 and 107 perpendicular to the major free edge,
- a topical exterior coating capable of delamination,
- a transverse score line 98 through the topical exterior coating intermediate the first and second ends, and
- at least one score line 102 running from the first end to the transverse score line 98;

C. a first rectangular major end flap 46 overlaying the first and second minor side flaps hingedly connected at a first end to the first major panel 20, said major end flap having
- a longitudinally extending major free edge 82 at its second end,
- first and second spaced apart parallel minor free edges 83 and 96 perpendicular to the major free edge,
- exterior and interior major surfaces,
- a transverse perforation line 66 intermediate and parallel to the first and second minor edges thereby defining a spout flap portion 64 and a fixed portion 62, said spout flap portion 64 having an inverted "C" style tuck tab slit cut 74,
- said spout flap portion 64 having a notch 84 on the first minor free edge and having
- a finger hole 75 on its major free edge positioned equidistantly between the notch 84 and the transverse perforation line 66,
- a first transverse adhesive means 94 for removably adhering the first major end flap to the underlying first minor side flap, and a second transverse adhesive means 88 for removably adhering the first major end flap to the underlying second minor side flap; and D. a second rectangular major end flap 44 inwardly folded overlaying the first major end flap 46 hingedly connected at a first end to the second major panel 16, said second major end flap having
- an opposed, longitudinally extending major free edge 114 at its second end,
- first and second spaced apart parallel minor free edges 110 and 128 perpendicular to the major free edge
- exterior and interior major surfaces, and a transverse perforation line 72 intermediate and parallel to the first and second minor free edges and overlaying the transverse perforation line 66 of the first major end flap defining a spout flap portion 70 and a fixed portion 68, a longitudinally extending pull tab 138 defined by a plurality of pull tab perforations 116 commencing at the first minor free edge 110 and extending to the transverse perforation line 72 and wherein the pull tab perforations 116 include a plurality of tuck tab defining perforations 118, a first transverse adhesive means 108 for removably adhering the second major end flap 44 to the underlying second minor side flap 42 on the spout flap portion proximate the first minor free edge 110 and extending from the pull tab perforation to the first end, a second transverse adhesive means 124 extending on the fixed portion 68 proximate the transverse perforation line 72, a third transverse adhesive means 126 on the fixed portion 68 proximate the second minor free edge 128, and first and second parallel spaced apart longitudinally extending adhesive means 120 and 122 for removably adhering the second major end flap 44 to the underlying major end flap 46.

2. The carton of claim 1 wherein the first rectangular major end flap 46 further includes an opposed pair of spaced apart parallel cuts 76 and 78 in the spout flap portion running form the first major free edge 82 and perpendicular thereto and a score line 80 extending between the termination of the pair of parallel cuts and parallel to the major free edge defining a finger hole 75 and a finger hole flap hingedly connected to the spout flap portion by the score line 80, and wherein the first and second adhesive means each comprise glue beads of hot melt adhesive.

3. The carton of claim 2 wherein the second rectangular side flap 42 comprises a plurality of score lines 102 running from the first end to the transverse score line 98.

4. A one piece paperboard blank 10 for an end-fillable linerless carton suitable for forming a top end, sift-proof sealed container, comprising:

A. first side panel 14, front panel 16, second side panel 18, rear panel 20 and glue flap panel 21 consecutively articulated along parallel vertical fold lines each said panel having an upper and a lower end;

B. a first bottom minor flap 30, a first major bottom flap 32, second minor bottom flap 34 and second major bottom flap 36 consecutively articulated to the lower ends of said panels along horizontal fold lines;

C. a first rectangular top minor flap 40, first top major flap 44, second minor top flap 42 and second major top flap 46 each consecutively articulated at a first end to upper ends of said panels along horizontal fold lines,

1. wherein the second top minor flap 42 includes an opposed major free edge at its second end opposite its first articulated end, an opposed pair of minor free edges, a topical exterior coating capable of delamination, a transverse score line through the exterior coating intermediate the first and second ends, and at least one score line running from the first end to the transverse score line;

2. wherein the second top major flap includes a longitudinally extending major free edge opposite its articulated end, first and second spaced apart parallel minor free edges perpendicular to the major free edge, exterior and interior major surfaces, a transverse perforation line intermediate and parallel to the first and second minor edges thereby defining a spout flap portion and a fixed portion, said spout flap portion having an inverted "C" style tuck tab slit cut, said spout flap portion having a notch on the first minor free edge and having a finger hole on its major free edge positioned equidistantly between the notch and the transverse perforation line;

3. wherein the first top major flap includes a longitudinally extending major free edge opposite its articulated end, first and second spaced apart parallel minor free edges perpendicular to the major free edge, exterior and interior major surfaces, and a transverse perforation line intermediate and parallel to the first and second minor edges defining an upper spout flap portion and an upper fixed portion, and a longitudinally pull tab defined by a plurality of pull tab perforations commencing at the second minor free edge and extending inwardly to the transverse perforation line and wherein the pull tab perforations include a plurality of tuck tab defining perforations.

5. The carton of claim 3 wherein in the second rectangular major end flap, each adhesive means comprise glue beads of hot melt adhesive.

6. The carton of claim 5 wherein in the first rectangular major end flap 46, the finger hole 75 is positioned equidistantly intermediate the perforation line 66 and the first free edge 83.

7. The carton blank of claim 4 wherein in the first rectangular major end flap 46, the finger hole 75 is positioned equidistantly intermediate the perforation line 66 and the first free edge 83.

* * * * *